US007474290B2

(12) United States Patent
Makuuchi et al.

(10) Patent No.: US 7,474,290 B2
(45) Date of Patent: Jan. 6, 2009

(54) SEMICONDUCTOR DEVICE AND TESTING METHOD THEREOF

(75) Inventors: Masami Makuuchi, Yokohama (JP); Norio Chujo, Tokyo (JP); Kengo Imagawa, Fujisawa (JP); Ritsuro Orihashi, Tokyo (JP); Yoshitomo Arai, Ohme (JP)

(73) Assignee: Renesas Technology Corp., Tokyo (JP)

( * ) Notice: Subject to any disclaimer, the term of this patent is extended or adjusted under 35 U.S.C. 154(b) by 625 days.

(21) Appl. No.: 10/981,715

(22) Filed: Nov. 5, 2004

(65) Prior Publication Data

US 2005/0122300 A1 Jun. 9, 2005

(30) Foreign Application Priority Data

Nov. 7, 2003 (JP) ..... 2003-378595
Oct. 26, 2004 (JP) ..... 2004-310341

(51) Int. Cl.
*G09G 3/36* (2006.01)

(52) U.S. Cl. ..... 345/87; 345/690; 345/88; 345/55

(58) Field of Classification Search ..... 345/87, 345/55, 88, 690
See application file for complete search history.

(56) References Cited

U.S. PATENT DOCUMENTS 6,535,011 B1 3/2003 Sakaguchi
6,809,541 B2 * 10/2004 Bu et al. ..... 324/765
6,876,347 B2 * 4/2005 Tashiro et al. ..... 345/87
2002/0158828 A1 10/2002 Isami et al.
2003/0201788 A1 10/2003 Sakaguchi et al.

FOREIGN PATENT DOCUMENTS

| | | |
|---|---|---|
| CN | 1383127 | 12/2002 |
| JP | 2001-099900 | 4/2001 |
| JP | 2002-156412 | 5/2002 |
| JP | 2002-236147 | 8/2002 |

* cited by examiner

*Primary Examiner*—Richard Hjerpe
*Assistant Examiner*—Leonid Shapiro
(74) *Attorney, Agent, or Firm*—Antonelli, Terry, Stout & Kraus, LLP.

(57) ABSTRACT

A semiconductor device according to the present invention has a liquid crystal driver circuit, and when gray-scale voltage thereof is tested, the gray-scale voltage (Vx) generated in a gray-scale voltage generator circuit provided therein is compared with reference voltage (e.g., Vx+ΔV) generated for testing the gray-scale voltage and the test result is output as binarized voltage from external terminals of the semiconductor device. This can speed up the gray-scale voltage test even in the case of higher gray scale in the liquid crystal driver circuit or increased number of output terminals of the semiconductor device. Therefore, it becomes possible to reduce the time and cost required for the test.

4 Claims, 7 Drawing Sheets

OPERATION OF REFERENCE VOLTAGE GENERATOR CIRCUIT

| GRAY-SCALE VALUE | GRAY-SCALE OUTPUT VOLTAGE | REFERENCE VOLTAGE SELECTION CONTROL | REFERENCE VOLTAGE | EXPECTED VALUE |
|---|---|---|---|---|
| x-1 | V(x-1) | 0 | V(x-1)+ΔV | L |
| | | 1 | V(x-1)-ΔV | H |
| x | V(x) | 0 | V(x)+ΔV | L |
| | | 1 | V(x)-ΔV | H |
| x+1 | V(x+1) | 0 | V(x+1)+ΔV | L |
| | | 1 | V(x+1)-ΔV | H |

SEMICONDUCTOR DEVICE AND TESTING METHOD THEREOF

The present application claims priority from Japanese application JP 2003-378595 filed on Nov. 7, 2003 and Japanese application JP 2004-310341 filed on Oct. 26, 2004 the contents of which are hereby incorporated by reference into this application.

BACKGROUND OF THE INVENTION

1. Field of the Invention

The present invention relates to a semiconductor device and a testing method thereof, and more particularly, it relates to a semiconductor device having a number of external terminals (output terminals) and a testing method for testing output voltage thereof.

2. Description of the Related Art

A semiconductor device provided with a driver circuit of a liquid crystal display (also referred to as a liquid crystal driver circuit, or LCD driver) drives the liquid crystal display (liquid crystal panel) by outputting multi-stage (multiple gray-scale) voltage from a number of external terminals (output pins).

Conventionally, a gray-scale voltage test of a semiconductor device provided with a liquid crystal driver circuit has been done by measuring voltage (e.g., analog voltage measurement) with using a tester. In the present specification, such a tester will be referred to as an Automatic Test Equipment by its abbreviation "ATE", hereinafter. However, the tester should not be limited to the ATE.

However, with the increase of the number of output terminals in the semiconductor device resulting from the higher definition of the liquid crystal display and with the introduction of higher gray scale in the liquid crystal display in recent years, problems such as extended time required for a gray-scale voltage test and increased cost for testing or manufacturing the semiconductor device (liquid crystal driver circuit) have occurred.

As a method for reducing the time required for the gray-scale voltage test, Japanese Patent Application Laid-Open No. 2002-156412 describes the technique in which differential voltage between output terminal voltage of the liquid crystal driver circuit and reference voltage of an ATE (tester) is detected and then the variances of the gray-scale voltage among the terminals are tested in respective output terminals of the liquid crystal driver circuit.

SUMMARY OF THE INVENTION

However, the technique described in Japanese Patent Application Laid-Open No. 2002-156412 has the following problems:

(1) Since output voltage measurement (analog voltage measurement) is performed by the ATE (tester), it takes long until the output voltage is stabilized, and therefore, the testing time is increased.

(2) If the determination range of the output voltage becomes very narrow as a result of the miniaturization of gray-scale voltage steps caused by the introduction of higher gray scale into the liquid crystal display, differential voltage between the output terminal voltage of the liquid crystal driver circuit and reference voltage of the ATE must be subdivided, and therefore, the testing time is increased.

(3) In order to implement the technique described in Japanese Patent Application Laid-Open No. 2002-156412, it is necessary to newly add a gray-scale voltage measuring circuit to the ATE, and thus, the existing (conventional) ATE can no longer be used.

An object of the present invention is to provide the technique capable of solving the problems mentioned above and reducing the time required for the gray-scale voltage test of a semiconductor device provided with a driver circuit of a liquid crystal display. Also, another object thereof is to provide the technique that can reduce the cost of testing/manufacturing a semiconductor device provided with a driver circuit of a liquid crystal display.

The typical ones of the inventions disclosed in this application will be briefly described as follows.

In order to achieve the above-mentioned objects, the semiconductor device having a liquid crystal driver circuit according to the present invention is characterized in that a binarized gray-scale voltage test signal is output when the gray-scale voltage test is carried out.

For instance, the present invention provides a semiconductor device having a liquid crystal driver circuit wherein, in a gray-scale voltage test of the semiconductor device, gray-scale voltage generated in a gray-scale voltage generator circuit of the semiconductor device is compared with reference voltage generated for testing the gray-scale voltage, and the test result is output as binarized voltage from an external terminal of the semiconductor device.

Also, the present invention provides a semiconductor device having a liquid crystal driver circuit wherein the liquid crystal driver circuit comprises: a gray-scale voltage generator circuit; and a gray-scale voltage selector circuit which receives gray-scale voltage generated in the gray-scale voltage generator circuit and selects gray-scale voltage corresponding to gray scale, and in a gray-scale voltage test of the semiconductor device, the gray-scale voltage generated in the gray-scale voltage generator circuit is compared with reference voltage generated for testing the gray-scale voltage in the gray-scale voltage selector circuit, and the test result is output as binarized voltage from an external terminal of the semiconductor device.

Also, the present invention provides a semiconductor device having a liquid crystal driver circuit, wherein the liquid crystal driver circuit comprises: a gray-scale voltage generator circuit; a gray-scale voltage selector circuit which receives gray-scale voltage generated in the gray-scale voltage generator circuit and selects gray-scale voltage corresponding to gray scale; and a buffer which temporarily retains information regarding gray-scale voltage selected in the gray-scale voltage selector circuit and gives the retained information to the gray-scale voltage selector circuit, and the gray-scale voltage selector circuit further comprises: a selector circuit that selects gray-scale voltage generated in the gray-scale voltage generator circuit based on an output from the buffer; an amplifier circuit which, in a gray-scale voltage test of the semiconductor device, compares the gray-scale voltage selected in the selector circuit with reference voltage generated for testing the gray-scale voltage, amplifies differential voltage between those voltages, and outputs the comparison result as binarized voltage from an external terminal; and selection means which selects either the reference voltage or output of the amplifier circuit as information to be input into the amplifier circuit.

Also, the present invention provides a testing method of a semiconductor device having a liquid crystal driver circuit wherein, in a gray-scale voltage test of the semiconductor device, gray-scale voltage generated in a gray-scale voltage generator circuit of the semiconductor device is compared with reference voltage generated for testing the gray-scale voltage, and a test of the gray-scale voltage of the semiconductor device is carried out by using binarized voltage which is output as the test result from an external terminal of the semiconductor device.

Also, the present invention provides a testing method of a semiconductor device having a liquid crystal driver circuit, wherein the liquid crystal driver circuit comprises: a gray-scale voltage generator circuit; and a gray-scale voltage selector circuit which receives gray-scale voltage generated in the gray-scale voltage generator circuit, and the gray-scale voltage generated in the gray-scale voltage generator circuit is compared with reference voltage generated for testing the gray-scale voltage in the gray-scale voltage selector circuit, and the gray-scale voltage of the semiconductor device is tested by using binarized voltage which is output from the semiconductor device as the test result.

Also, the present invention provides a testing method of the semiconductor device wherein, in the gray-scale voltage test, an external terminal of the semiconductor device and a comparator of an ATE (tester) are electrically connected, and the gray-scale test is carried out at once in the comparator of the ATE by using the binarized voltage output from the external terminal.

According to the present invention, it is possible to reduce the time required for the gray-scale voltage test of the semiconductor device provided with a driver circuit of a liquid crystal display (liquid crystal driver circuit).

In addition, it is also possible to reduce the testing/manufacturing cost of the semiconductor device provided with a driver circuit of a liquid crystal display.

DETAILED DESCRIPTION

Hereinafter, embodiments of the present invention will be described in detail with reference to the accompanying drawings. Note that components having the same function are denoted by the same reference symbols throughout the drawings for describing the embodiment, and the repetitive description thereof will be omitted.

Figure 1:
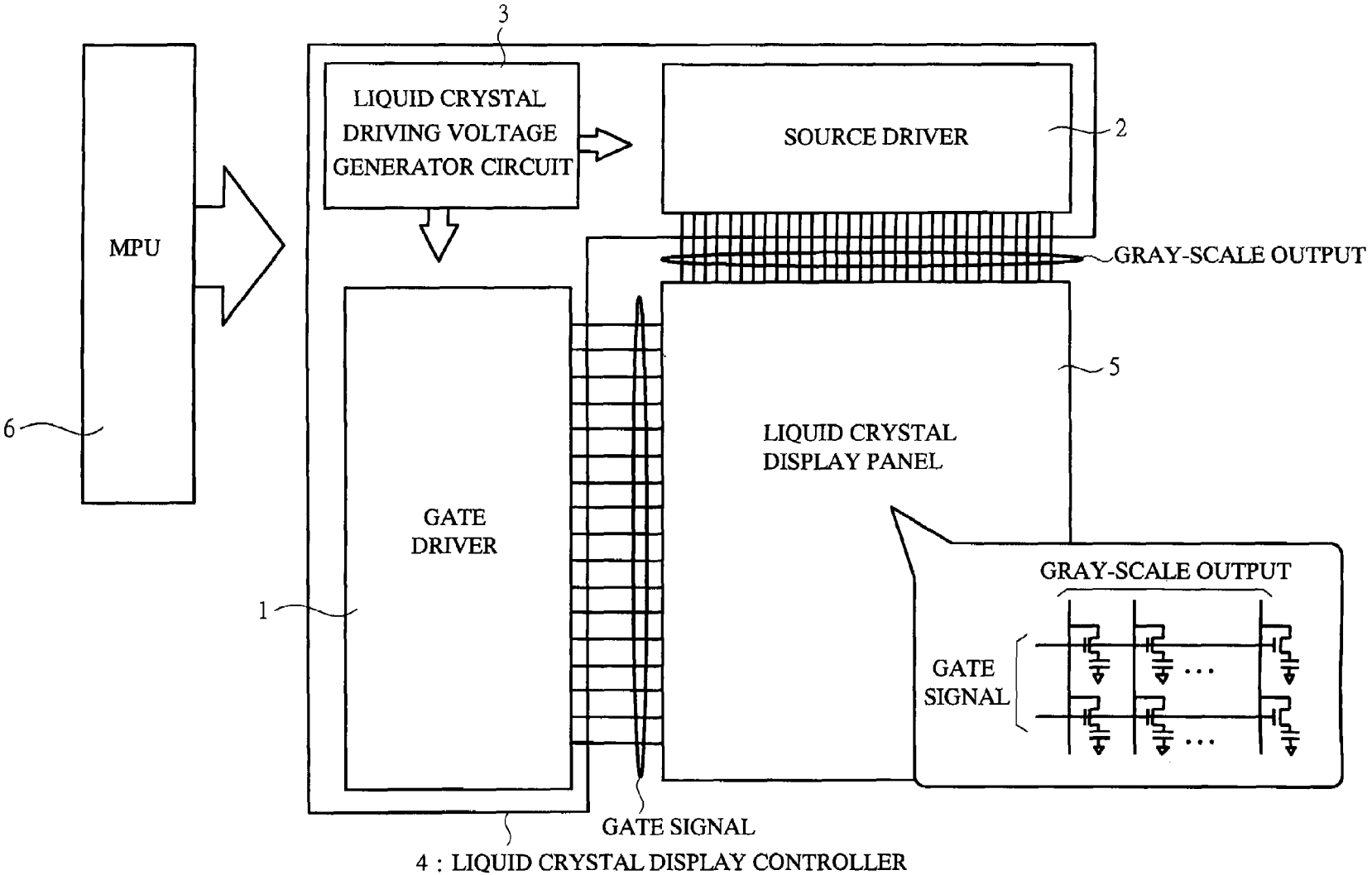
FIG. 1 is a block diagram showing one example of a semiconductor device having a liquid crystal driver circuit in an embodiment of the present invention.

FIG. 1 is a view showing one example of configuration of a semiconductor device having a liquid crystal driver circuit in an embodiment of the present invention. In this configuration example of the semiconductor device, it comprises a gate driver 1, a source driver 2, a liquid crystal driving voltage generator circuit 3, a liquid crystal display panel 5, an MPU 6, and so forth.

The gate driver 1 applies a gate signal to the liquid crystal display panel 5. The source driver 2 applies gray-scale output voltage to the liquid crystal display panel 5. The liquid crystal driving voltage generator circuit 3 generates driving voltage for the liquid crystal display panel 5. For example, the liquid crystal display panel 5 has structure in which TFTs are arranged in a matrix and brightness thereof is controlled by charging retention volume of each pixel. The MPU 6 controls operations/processes of the gate driver 1 and the source driver 2.

"The semiconductor device having a driver circuit of a liquid crystal display (liquid crystal driver circuit)" described below in the embodiments of the present invention may be (1) composed of the source driver 2, alternatively (2) composed of the gate driver 1, the source driver 2, and the liquid crystal driving voltage generator circuit 3.

In the case of the semiconductor device having the configuration (2) mentioned above, a unit containing the gate driver 1, the source driver 2, and the liquid crystal driving voltage generator circuit 3 may be referred to as a liquid crystal display controller 4 in some cases. In addition, it is also possible to configure one semiconductor device by adding the MPU 6 to the components described above.

The semiconductor device having the configuration (1) described above is mainly used for driving a large-size liquid crystal display, while the semiconductor device having the configuration (2) is used for driving, for example, a small-size color TFT liquid crystal display provided in a mobile phone.

In FIG. 1, the liquid crystal display controller 4 is connected to the liquid crystal display panel 5 in which TFTs are arranged in a matrix. And the liquid crystal display controller 4 applies to the liquid crystal display panel 5 a gate signal that selects a given display line from the gate driver 1, and controls the intensity of respective pixels by applying gray-scale output voltage from the source driver 2 to the respective pixels of the selected display line so as to charge the retention volume of the target pixels. In addition, the liquid crystal display controller 4 is connected to the MPU 6 that controls operations/processes of the gate driver 1 and source driver 2.

In the following, the semiconductor device having a liquid crystal driver circuit according to the embodiments of the present invention and the testing method thereof will be described with reference to FIGS. 1 to 7.

First Embodiment

Figure 2:
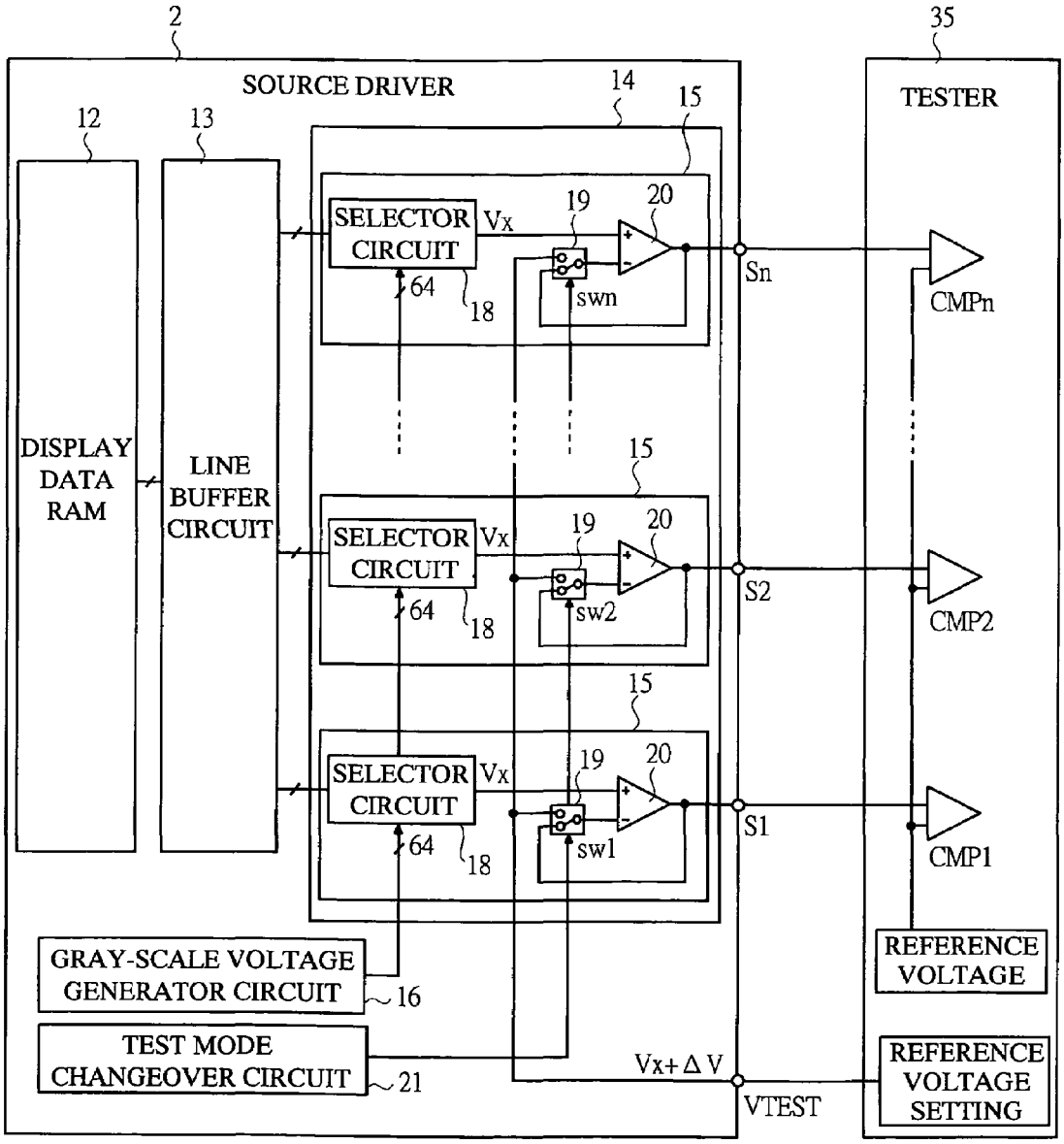
FIG. 2 is a view showing configuration of the semiconductor device having a liquid crystal driver circuit in the first embodiment of the present invention.

FIG. 2 shows configuration of the semiconductor device having a liquid crystal driver circuit in the first embodiment of the present invention. As the first embodiment of the present invention, FIG. 2 shows the case where the semiconductor device having a liquid crystal driver circuit is composed of the source driver (which corresponds to the configuration of (1) described above). More specifically, the liquid crystal driver circuit in the semiconductor device of the first embodiment is the source driver 2 shown in FIG. 1.

In FIG. 2, the source driver 2 is composed of a display data RAM 12 that stores data to be written or read via an external interface, a line buffer circuit 13 that retains data written in the display data RAM 12, a gray-scale voltage generator circuit 16 that generates gray-scale voltage at a predetermined level, a gray-scale voltage selector circuit 14 that outputs gray-scale voltage in accordance with gray-scale setting data retained in the line buffer circuit 13 based on the predetermined gray-scale voltage generated in the gray-scale voltage generator circuit 16, and a test mode changeover circuit 21 that changes operation modes between normal operation and gray-scale testing.

In addition, S1 to Sn shown in FIG. 2 represent a number of output terminals (output pins) provided in the semiconductor device according to the first embodiment, which are used to output gray-scale voltage in normal operation. Also, VTEST shown in the same figure denotes the terminal provided for inputting (applying) reference voltage generated for testing the gray-scale voltage in the gray-scale test. An ATE 35 (tester) is provided in order to carry out the gray-scale test of the semiconductor device. The ATE 35 is provided with a reference voltage setting unit, a plurality of comparators CMP1 to CMPn and so forth, and can be electrically connected to the output terminals of the semiconductor device.

The gray-scale voltage selector circuit 14 includes a plurality of switch circuits 15 that are composed of a selector circuit 18, an amplifier circuit 20, and an operation changeover switch 19.

In addition, the semiconductor device can be configured without the display data RAM 12 if it is not necessary.

In the source driver 2, in normal operation, the test mode changeover circuit 21 controls the operation changeover switch 19 so that the output terminal of the amplifier circuit 20 is connected to the inverting input terminal denoted by the sign "-". By doing so, the amplifier circuit 20 is placed in the operating state equivalent to the buffer circuit, and the gray-scale voltage selected via the selector circuit 18 is output to the output terminal.

On the one hand, in the source driver 2, during a gray-scale test, the external interface of the display controller (not shown) and an output terminal and a VTEST terminal of the gray-scale voltage selector circuit 14 (switch circuit 15) are connected to the ATE 35, respectively, and the gray-scale test is performed by a test signal from the ATE 35.

More specifically, during the gray-scale test (gray-scale test mode and test mode), the source driver 2 switches the operation changeover switch 19 by the ATE 35 via the test mode changeover circuit 21 so that the VTEST terminal is connected to the inverting input terminal denoted by the sign "-" of the amplifier circuit 20. Then, the source driver 2 compares the gray-scale voltage selected via the selector circuit 18 with the reference voltage applied via the VTEST terminal in the amplifier circuit 20, and outputs the comparison result to the output terminal.

Usually, the amplifier circuit 20 has a high amplification factor. Thus, during the gray-scale test, the amplifier circuit 20 amplifies differential voltage between the gray-scale voltage and the reference voltage, thereby outputting a voltage value in the vicinity of power supply voltage on either the positive side (H) or negative side (L) of the buffer circuit as the output terminal voltage.

Therefore, in the gray-scale test, the output voltage of the source driver 2 becomes any of the predetermined binarized voltages ("H" or "L") by setting the given gray-scale data from the ATE 35 via the display data RAM 12 and the line buffer circuit 13 and applying the reference voltage onto the VTEST terminal in the ATE 35. Since the output of the gray-scale test signal is binarized voltage, the gray-scale voltage of a plurality of output terminals (output pins) of the source driver 2 can be simultaneously tested in a plurality of comparators CMP1 to CMPn provided in the ATE 35.

Figure 3:
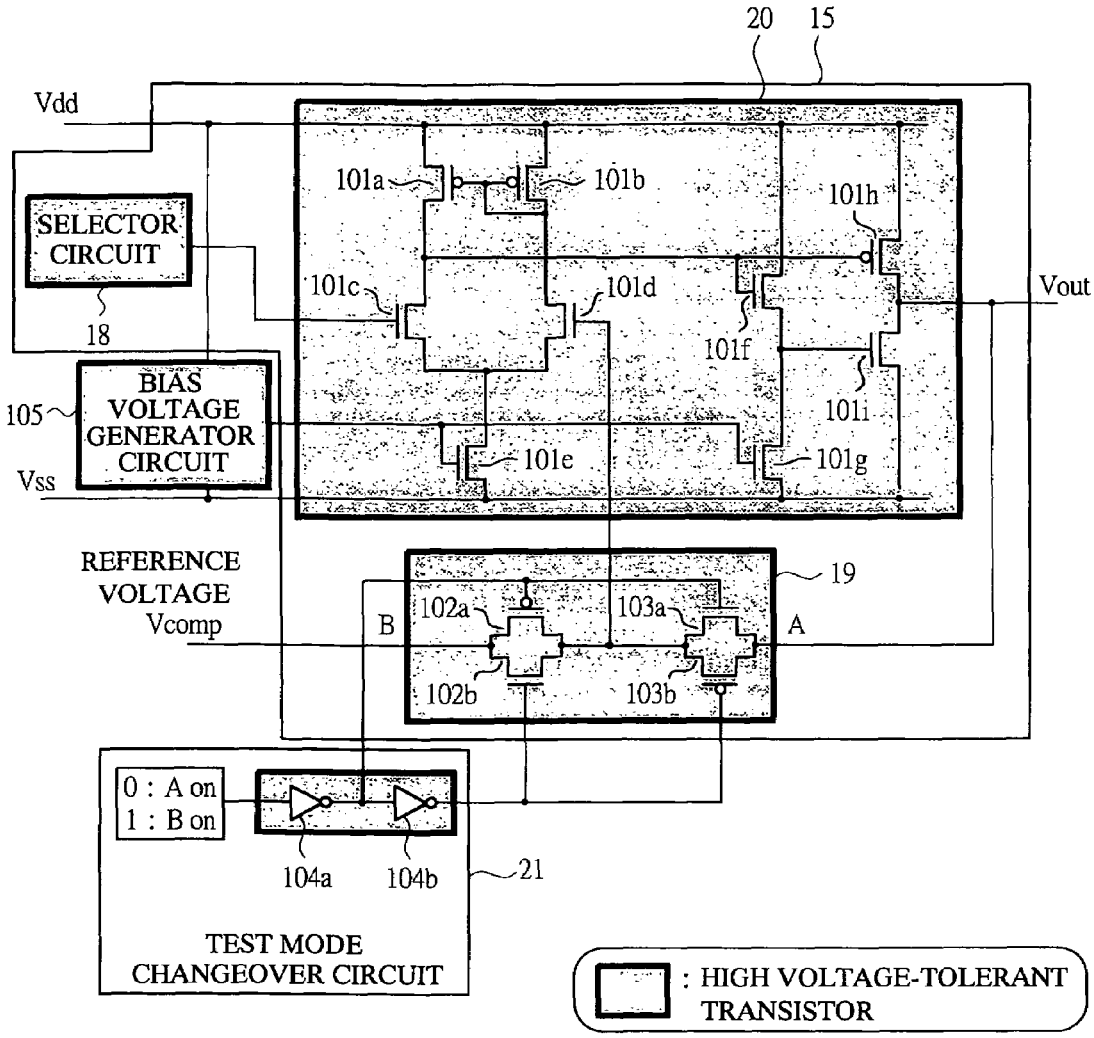
FIG. 3 is a view showing a configuration example of a switch circuit provided in the semiconductor device in the first embodiment of the present invention.
Figure 5:
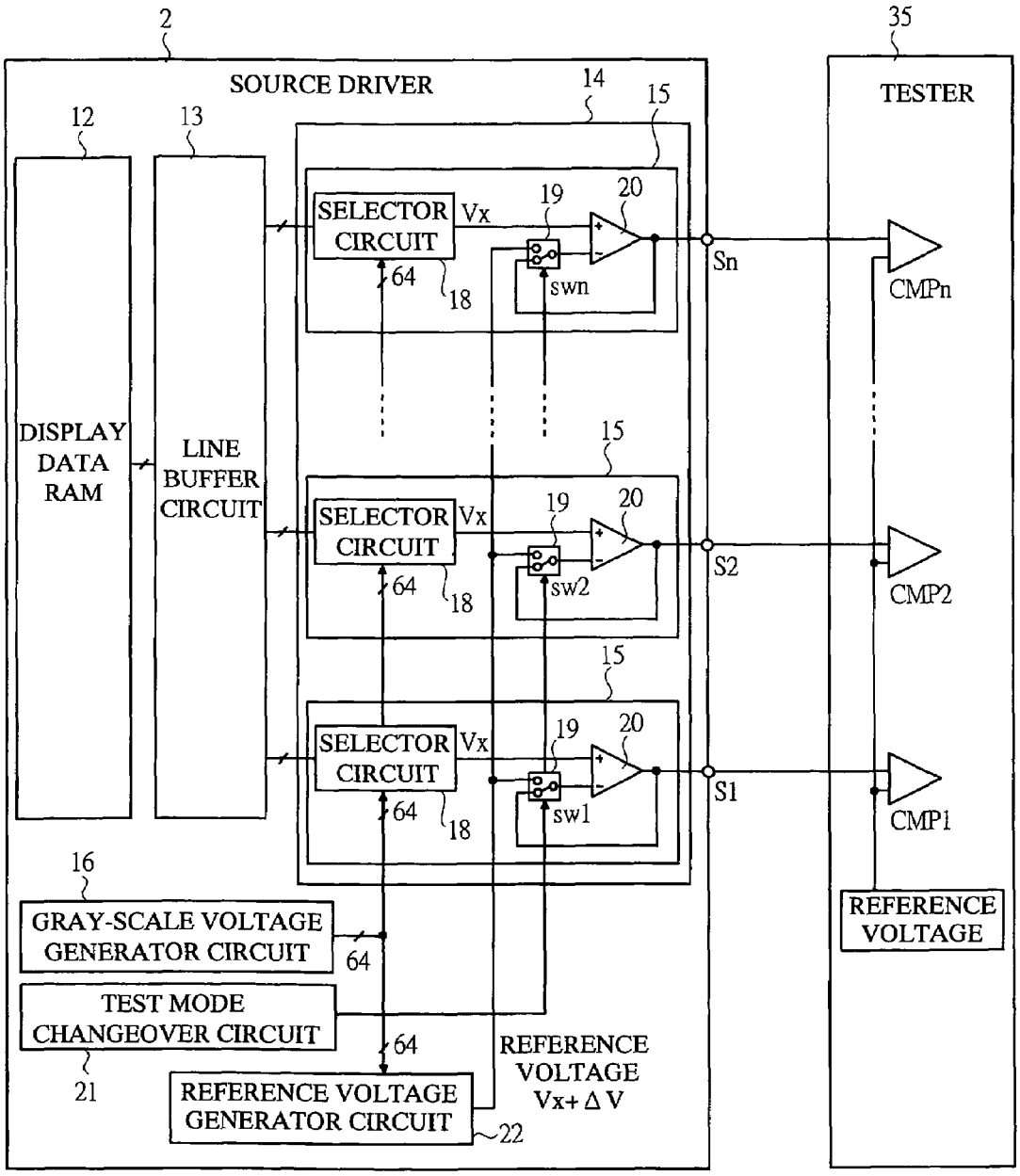
FIG. 5 is a view showing configuration of the semiconductor device having a liquid crystal driver circuit in the second embodiment of the present invention.

FIG. 3 shows a configuration example of a plurality of switch circuits 15 provided in the above mentioned gray-scale voltage selector circuit 14. In FIG. 3, the switch circuit 15 includes the amplifier circuit 20 having transistors 101*a* to 101*i*, an operation changeover switch 19 composed of a transparent switch that has transistors 102*a*, 102*b*, and transistors 103*a*, 103*b*, and a selector circuit 18 that selects gray-scale voltage generated in the gray-scale voltage generator circuit 16 (not shown in FIG. 3). In addition, a bias voltage generator circuit 105 that generates voltage level necessary for the operation of the amplifier circuit 20 and a test mode changeover circuit 21 are respectively connected to the switch circuit 15. Since the test mode changeover circuit 21 controls the operation changeover switch 19 having higher operating voltage by means of a logic circuit (for example, an internal logic circuit; not shown in FIG. 3) having lower operating voltage than the operation changeover switch 19, it is provided with an inverting gate circuit 104*a* that has the level shift function and an inverting gate circuit 104*b* that operates with the operating voltage of the operation changeover switch 19 (high voltage). The output terminal Vout of the amplifier circuit 20 is connected to the output terminals of the semiconductor device according to the present invention (any of the output terminals S1 to Sn shown in FIG. 2) and the terminal A of the operation changeover switch 19. In addition, the voltage supplied from the ATE (tester) 35 through the terminal VTEST (refer to FIG. 2) or the voltage supplied from a reference voltage generator circuit 22 to be described later in the second embodiment with reference to FIG. 5 is applied to the terminal B of the operation changeover switch 19 as reference voltage Vcomp.

In the following, the outline of the operation of the switch circuit 15 shown in FIG. 3 will be described. When logical state of the test mode changeover circuit 21 is set to "0" in its normal operation, the transparent switch composed of the transistors 102*a* and 102*b* is in an OFF state, and the transparent switch composed of the transistors 103*a* and 103*b* is in an ON state. By doing so, the output terminal Vout of the amplifier circuit 20 is connected to the transistor 101*d* (the gate thereof) that is the inverting input of the amplifier circuit 20 through the operation changeover switch 19. Consequently, the amplifier circuit 20 acts as a buffer circuit having the voltage amplification factor of about 1, and voltage equal to the gray-scale voltage selected by the selector circuit 18 is output from the output terminal of the semiconductor device according to the present invention through the output terminal Vout of the amplifier circuit 20.

On the one hand, during the gray-scale test of the semiconductor device, the logic state of the test mode changeover circuit 21 is set to "1". In this manner, the transparent switch composed of the transistors 102*a* and 102*b* is in an ON state and the transparent switch composed of the transistors 103*a* and 103*b* is in an OFF state. Furthermore, the reference voltage Vcomp supplied from the ATE 35 or the reference voltage generator circuit 22 is applied to the gate of the transistor 101*d* through the operation changeover switch 19. Consequently, the voltage amplification factor of the amplifier circuit 20 becomes higher when compared with that in the case where the test mode changeover circuit 21 is normally operated, and thus it acts as, so to speak, the amplifier circuit having high amplification factor. Therefore, the amplifier circuit 20 amplifies the difference (differential voltage) between the gray-scale voltage selected by the selector circuit 18 and the reference voltage Vcomp with the voltage amplification factor mentioned above. When the level of the gray-scale voltage is higher than the reference voltage Vcomp, one Vdd of the power supply voltages of the amplifier circuit 20 or the voltage in the vicinity of the power supply voltages is output from the output terminal Vout thereof. In addition, when the level of the above gray-scale voltage is lower than the reference voltage Vcomp, other Vss of the power supply voltages of the amplifier circuit 20 or the voltage in the vicinity of the power supply voltages is output from the output terminal Vout of the amplifier circuit 20.

In the foregoing, one example of the switch circuit 15 has been described with reference to FIG. 3. However, it is obvious that, in the embodiments of the semiconductor device according to the present invention, the switch circuit 15 or its equivalents are not limited to the configurations described above. For instance, the configuration as follows is also available, in which a part or all of the transistors 101*a* to 101*i*, 102*a*, 102*b*, 103*a*, and 103*b* shown as field effect transistors in FIG. 3 are replaced by bipolar transistors (in this case, the gate of the transistor 101*d* described above is replaced by the base), and the above-described logic circuit built in the test mode changeover circuit 21 operates at the operating voltage equivalent or close to that of the operation changeover switch 19. Thus, it is needless to say that the implementation of the method of testing or manufacturing the semiconductor device according to the present invention is not limited to the configuration of the switch circuit 15 described above.

Figure 4:
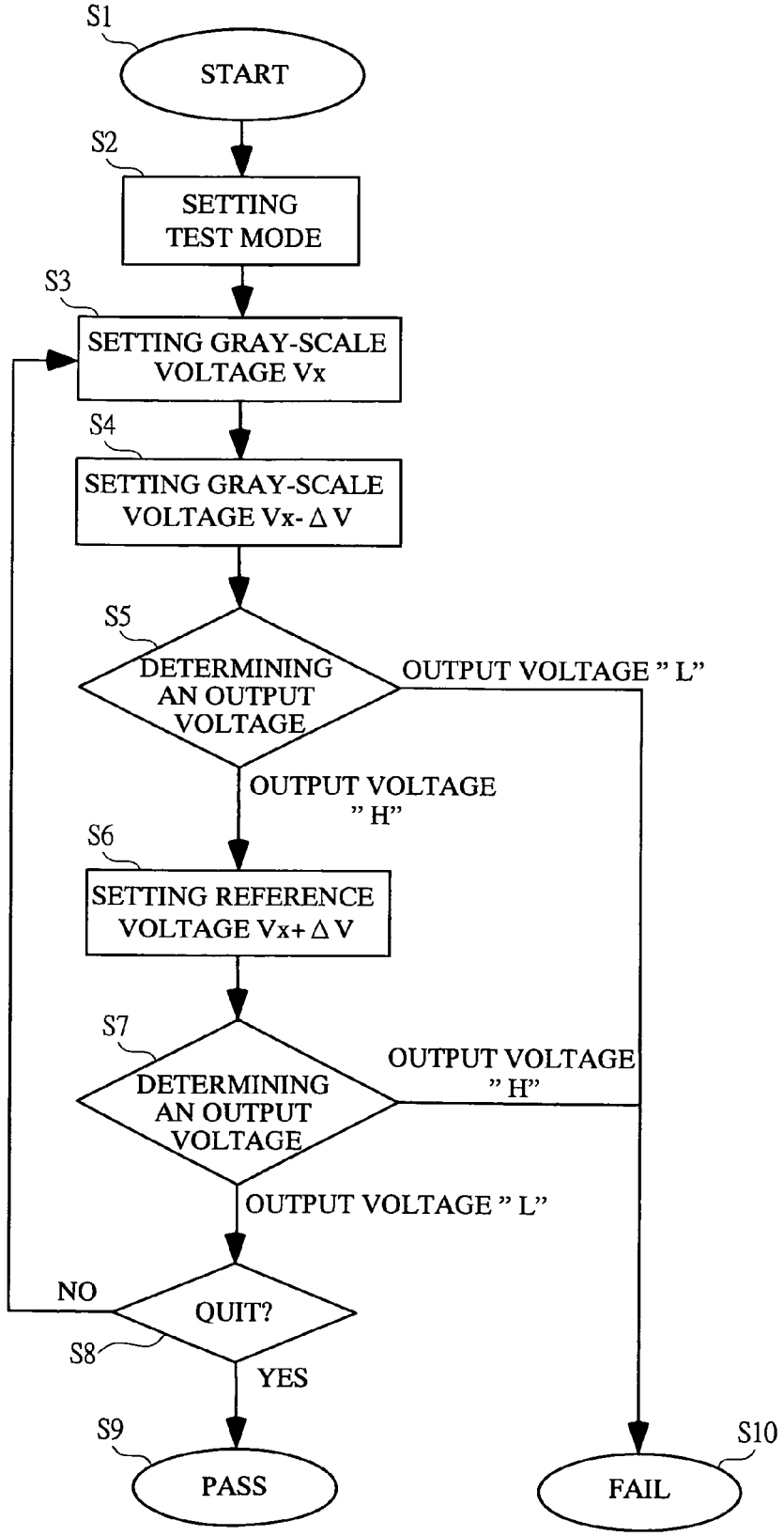
FIG. 4 is a process flow diagram of a testing method of the semiconductor device having a liquid crystal driver circuit in the embodiment of the present invention.

Next, FIG. 4 shows the process flow regarding a testing method of a semiconductor device having a liquid crystal driver circuit in the embodiments of the present invention. First, a source driver 2 is set to the gray-scale test mode mentioned above (S2), and then, the gray-scale setting data is set to a line buffer circuit 13 so that a selector circuit 18 can select the gray-scale voltage Vx (S3). Next, the ATE 35 applies the reference voltage having a voltage value of (Vx−ΔV) to the VTEST terminal (S4), and the ATE 35 compares the voltage of an output terminal of the source driver 2 with an expected value and makes a determination (S5).

If the source driver 2 is normal in this determination of the output voltage, a potential difference between input terminals of the amplifier circuit 20 is +ΔV, voltage corresponding to "H" is output to the output terminal voltage of the source driver 2, and the ATE 35 compares it with the expected value and makes a determination (S5—output voltage "H"). When the output voltage is "L", the result to the corresponding output terminal will be FAIL (bad) (S10).

Then, the ATE 35 applies reference voltage having a voltage value of (Vx+ΔV) to the VTEST terminal (S6), and compares the output terminal voltage of the source driver 2 with an expected value and makes a determination (S7).

If the source driver 2 is normal in this determination of the output voltage, a potential difference between the input terminals of the amplifier circuit 20 is −ΔV, the voltage corresponding to "L" is output to the output terminal voltage of the source driver 2, and the ATE 35 compares it with the expected value and makes a determination (S7—output voltage "L"). When the output voltage is "H", the result to the corresponding output terminal will be FAIL (bad) (S10).

Through the process steps of S3 to S7, by setting the reference voltage to (Vx±ΔV) relative to the gray-scale voltage Vx that the source driver 2 has internally selected, it will be tested whether or not the gray-scale voltage is in the predetermined voltage range. When it is normal, the result to the output terminal will be PASS (good) (S9).

It is obvious that, when a test is further done for another gray-scale voltage value Vx', the process steps of S3 to S7 is similarly repeated with using the gray-scale voltage value (S8). In addition, for the purposes of illustration, the reference voltage herein is set to (Vx±ΔV). However, it is needless to say that the test can be carried out even by setting a given voltage range.

Figure 7:
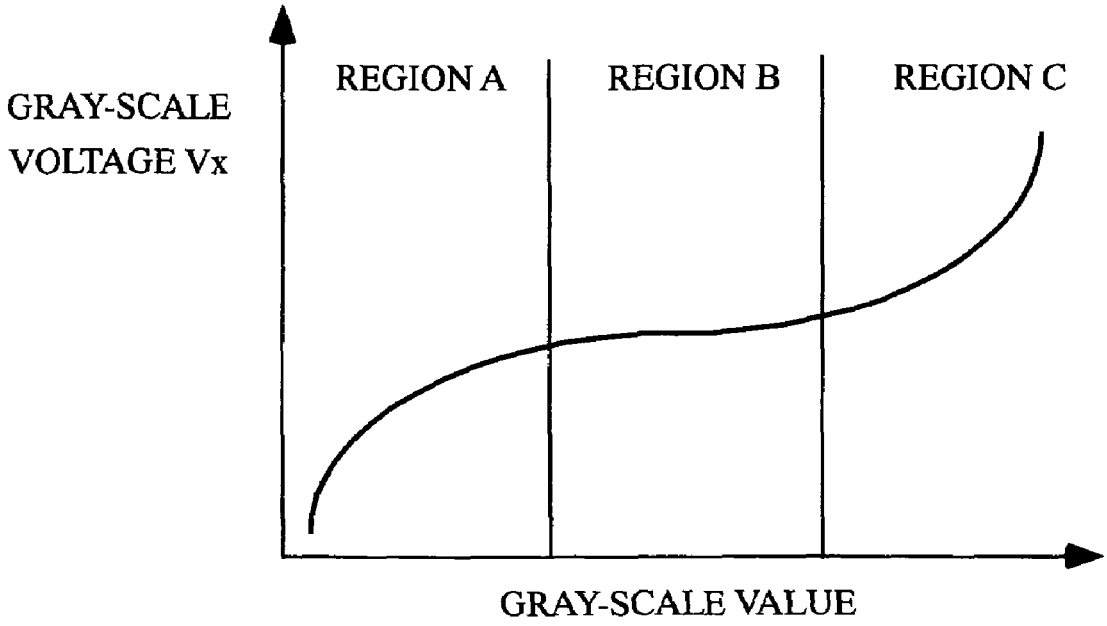
FIG. 7 is a view showing one example of a relation of gray-scale voltage and gray scale in the embodiment of the present invention.

In addition, a liquid crystal display has the characteristic that the display brightness is increased in a curve along with the increase of the input voltage. And when a relation between the gray-scale voltage Vx and the gray-scale value is set to have the nonlinear characteristic as shown in FIG. 7 in a liquid crystal driver circuit, the magnitude of ΔV relative to the selected gray-scale voltage Vx can be changed in accordance with the relation between the gray-scale voltage Vx and the gray-scale value in this embodiment. More specifically, since the variation (inclination) of the gray-scale voltage Vx relative to the gray-scale value is large in the areas denoted by A and C in FIG. 7, ΔV is also set roughly. On the other hand, since the variation (inclination) of the gray-scale voltage Vx relative to the gray-scale value is small in the area denoted by B in FIG. 7, ΔV is also set minutely. By doing so, the gray-scale voltage test suitable for the characteristics of the liquid crystal display can be realized and the precision of the gray-scale voltage test can be improved.

In addition, FIG. 2 illustrates the principle of the gray-scale test according to the present invention and shows the configuration provided with the VTEST terminal for input of the reference voltage for the sake of explanation. However, the configuration in which this terminal is replaced by other terminal that is unused in the gray-scale test is also available, for instance.

In addition, by adopting the configuration in which a plurality of reference voltage setting units are arranged in the ATE 35 or the configuration in which a plurality of reference voltage input terminals corresponding to the VTEST terminal are arranged, different reference voltages can be applied to each of a plurality of switch circuits 15. Therefore, the different gray-scale voltage test can be carried out for each switch circuit (each output terminal).

For instance, when (Vx+ΔV) is applied to one group of output terminals and (Vx−Δx) is applied to another group of output terminals, "H" and "L" are mixed in the output from the source driver 2. By applying this, "H" and "L" are alternately output from the output terminals (if they are normal) when (Vx+ΔV) is applied to the output terminals of odd number and (Vx−ΔV) is applied to the output terminals of even number. In this manner, a short among output terminals can be detected, thus improving the reliability of the gray-scale test.

The testing methods and configuration in which reference voltages of different voltage values are applied are also available, for example, (Vx+Δ1) is applied to one group of output terminals, while (Vx+ΔV2) is applied to another group of output terminals, alternatively, (Vx1+ΔV) is applied to one group of output terminals, while (Vx2+ΔV) is applied to another group of output terminals, etc.

In addition, it is obvious that the present invention is not limited to the gray-scale test described above, and the present invention can be used in a functional test of, for example, a liquid crystal display controller by adjusting the combination of the gray-scale setting data and the reference voltages.

Second Embodiment

Subsequently, as a semiconductor device having a liquid crystal driver circuit in the second embodiment of the present invention, configuration and one example of the operation in the case where a reference voltage generator circuit is arranged within a display controller will be described. FIG. 5 shows configuration of a semiconductor device having the reference voltage generator circuit (the reference voltage generator circuit 22 in the figure) arranged within the source driver.

The liquid crystal driver circuit in the semiconductor device of the second embodiment is applied to, for example, the source driver 2 shown in FIG. 1.

The liquid crystal display controller 4 including this source driver 2 is composed of a display data RAM 12 that stores data written or read through an external interface, a line buffer circuit 13 that retains data written to the display data RAM 12, a gray-scale voltage generator circuit 16 that generates gray-scale voltage at a predetermined level, a gray-scale voltage selector circuit 14 that outputs gray-scale voltage according to the gray-scale setting data retained in the line buffer circuit 13 based on the predetermined gray-scale voltage generated in the gray-scale voltage generator circuit 16, a test mode changeover circuit 21 that switches the operation mode between normal operation and a gray-scale test, and a reference voltage generator circuit 22 that generates the reference voltage based on the gray-scale voltage generated in the gray-scale voltage generator circuit 16.

The gray-scale voltage selector circuit 14 includes plurality of switch circuits 15 composed of a selector circuit 18, an amplifier circuit 20, and an operation changeover switch 19.

In normal operation, the source driver 2 performs the operations equivalent to those of the source driver in the first embodiment described with reference to FIG. 2. On the other hand, in the gray-scale test, the source driver 2 switches the operation changeover switch 19 to apply the reference voltage generated in the reference voltage generator circuit 22 to the inverting input terminal denoted by the sign "-" of the amplifier circuit 20, and then, compares the gray-scale voltage selected in the amplifier circuit 20 via the selector circuit 18 with the reference voltage, and outputs the comparison result to the output terminals.

Usually, the amplifier circuit has a high amplification factor. Thus, during the gray-scale test, the amplifier circuit 20 amplifies differential voltage between the gray-scale voltage and the reference voltage, thereby outputting a voltage value in the vicinity of power supply voltages either on the positive side (H) or negative side (L) of the buffer circuit as the output terminal voltage.

In the second embodiment, since the reference voltage in the gray-scale test is generated inside the circuit of the source driver 2, the gray-scale test can be carried out relatively within the circuit, and thus, it is possible to reduce the test time. More specifically, in the second embodiment, the test time can be reduced because the rising edge of the reference voltage generated when reference voltage is applied from outside of the semiconductor device shown in FIG. 1 is negligible.

In addition, in order to improve the precision of the gray-scale voltage test of the source driver 2, though not shown in FIG. 5, alternative configuration in which the reference voltage generated in the source driver 2 is measured by the ATE 35 via the VTEST terminal is also acceptable.

Figure 6:
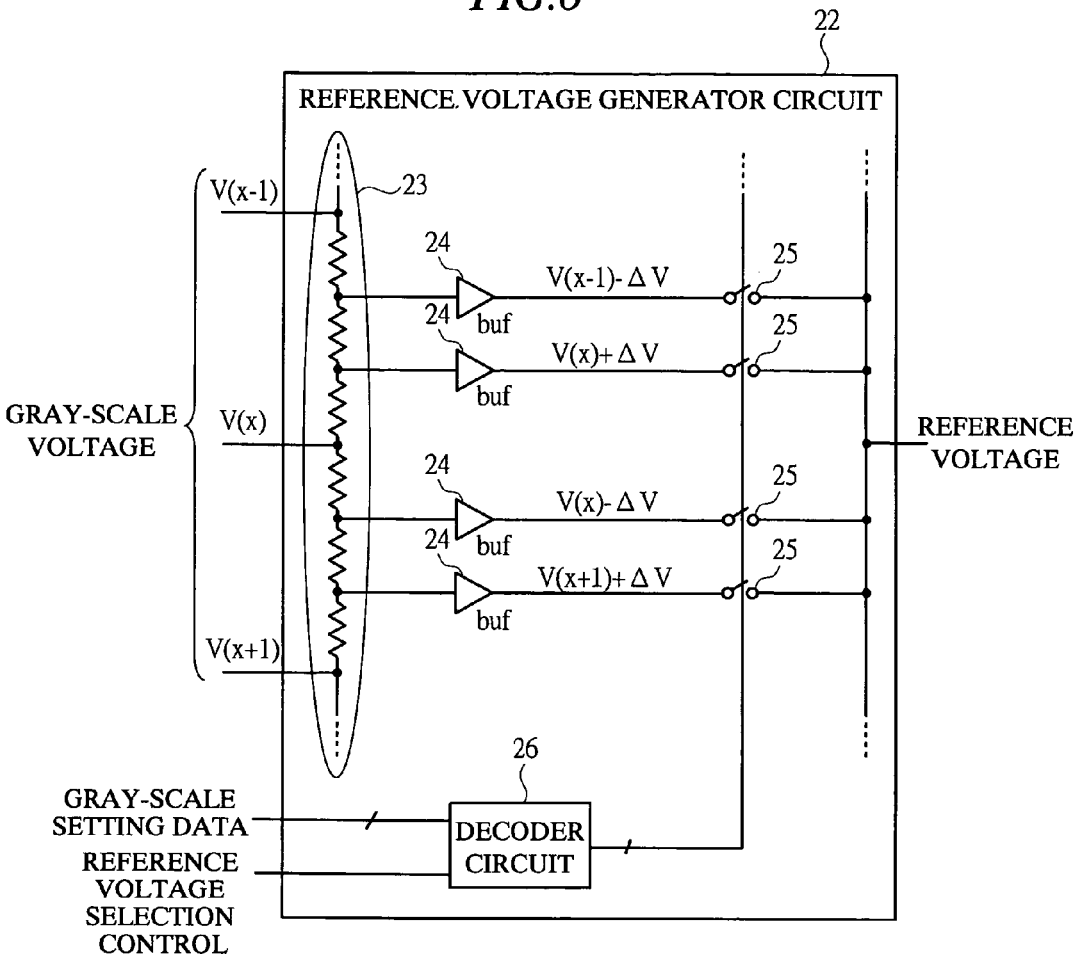
FIG. 6 is a view showing circuit configuration and one example of the operation of a reference voltage generator circuit of the semiconductor device in the second embodiment of the present invention.

Next, the circuit configuration and one example of operation of the reference voltage generator circuit 22 of the semiconductor device in the second embodiment will be described with reference to FIG. 6. FIG. 6 shows detailed configuration of the reference voltage generator circuit 22.

The reference voltage generator circuit 22 in the second embodiment is composed of a reference voltage resistor 23 that generates reference voltage for each gray-scale voltage based on the gray-scale voltage generated in the gray-scale voltage generator circuit 16, a plurality of buffer circuits 24 that amplify each divided voltage by the reference voltage resistors 23 with the amplification factor of 1, a plurality of switches 25 that switch the output of the buffer circuit 24 and connect it to the gray-scale voltage selector circuit 14 as reference voltage, and a decoder circuit 26 that controls ON/OFF of a plurality of switches 25 based on gray-scale setting data and reference voltage selection signal.

Data identical to the gray-scale setting data to be set to the gray-scale voltage selector circuit 14 is set as the gray-scale setting data that is the control input of the decoder circuit 26, and as shown in FIG. 6, any of $V(x)\pm\Delta V$ is output as the reference voltage based on reference voltage selection signal when the gray-scale voltage is $V(x)$. The table in the lower part of FIG. 6 summarizes operations of the reference voltage generator circuit 22. In this case, the selection of 1/0 of the reference voltage selection signal corresponds to the step of setting the reference voltage in S4 or S6 of the process flow of the gray-scale test shown in FIG. 4.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

What is claimed is:

1. A semiconductor device having a liquid crystal driver circuit, wherein said liquid crystal driver circuit comprises: a gray-scale voltage generator circuit; a gray-scale voltage selector circuit which receives gray-scale voltage generated in said gray-scale voltage generator circuit and selects gray-scale voltage corresponding to gray scale; and a buffer which temporarily retains information regarding gray-scale voltage selected in said gray-scale voltage selector circuit and gives said retained information to said gray-scale voltage selector circuit, and said gray-scale voltage selector circuit further comprises:

a selector circuit that selects gray-scale voltage generated in said gray-scale voltage generator circuit based on an output from said buffer;

an amplifier circuit which, in a gray-scale voltage test of said semiconductor device, compares the gray-scale voltage selected in said selector circuit with reference voltage generated for testing said gray-scale voltage, amplifies differential voltage between those voltages, and outputs the comparison result as binarized voltage from an external terminal; and selection means which selects either said reference voltage or output of said amplifier circuit as information to be input into said amplifier circuit.

2. The semiconductor device according to claim 1, further comprising: storage means which is connected to said buffer, stores and retains information to be given to said buffer via an external interface of said semiconductor device.

3. The semiconductor device according to claim 1, wherein said reference voltage is set outside said semiconductor device.

4. The semiconductor device according to claim 1, wherein said reference voltage is generated in a reference voltage generator circuit formed in said semiconductor device.

* * * * *